US006693545B2

(12) United States Patent
Brown et al.

(10) Patent No.: US 6,693,545 B2
(45) Date of Patent: Feb. 17, 2004

(54) PERSONAL ALARM DEVICE TRANSMITTING TELEPHONE NUMBER FOR ALARM CONFIRMATION AND INQUIRY

(75) Inventors: Michael Wayne Brown, Georgetown, TX (US); Rabindranath Dutta, Los Angeles, CA (US); Michael A. Paolini, Round Rock, TX (US); Newton James Smith, Jr., Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 22 days.

(21) Appl. No.: 10/062,364

(22) Filed: Jan. 31, 2002

(65) Prior Publication Data

US 2003/0141977 A1 Jul. 31, 2003

(51) Int. Cl.[7] ..... G08B 23/00
(52) U.S. Cl. ..... 340/573.1; 340/539
(58) Field of Search ..... 340/573.1, 539; 379/37, 38, 39, 40

(56) References Cited

U.S. PATENT DOCUMENTS

| | | | | |
|---|---|---|---|---|
| 5,128,979 A | | 7/1992 | Reich et al. | |
| 5,479,482 A | | 12/1995 | Grimes | |
| 5,537,102 A | | 7/1996 | Pinnow | |
| 5,625,668 A | | 4/1997 | Loomis et al. | |
| 5,862,201 A | | 1/1999 | Sands | |
| 5,942,986 A | * | 8/1999 | Shabot et al. | 340/7.29 |
| 5,946,626 A | | 8/1999 | Foladare et al. | |
| 6,028,514 A | * | 2/2000 | Lemelson et al. | 340/539 |
| 6,198,914 B1 | | 3/2001 | Saegusa | |
| 6,201,856 B1 | | 3/2001 | Orwick et al. | |
| 6,239,700 B1 | * | 5/2001 | Hoffman et al. | 340/539 |
| 6,262,666 B1 | * | 7/2001 | Lodichand | 340/573.1 |
| 6,366,646 B1 | * | 4/2002 | Miller | 379/40 |
| 6,369,705 B1 | * | 4/2002 | Kennedy | 340/506 |
| 6,456,695 B2 | * | 9/2002 | Lee | 379/41 |
| 6,509,833 B2 | * | 1/2003 | Tate | 340/539 |

FOREIGN PATENT DOCUMENTS

| | | |
|---|---|---|
| JP | 8065413 | 3/1996 |

* cited by examiner

*Primary Examiner*—John Tweel
(74) *Attorney, Agent, or Firm*—Cynthia S. Byrd; Streets & Steele; Jeffrey L. Streets

(57) ABSTRACT

A method and system that allows individuals to transmit an alarm signal from a personal alarm device having a keypad, programmable register, a transmitter, and electrical power source. The keypad facilitates entry of a call-back telephone number into a programmable memory register and triggering the transmission of an alarm signal. The alarm signal is transmitted to a central alarm monitoring server that processes the alarm signal and initiates the necessary actions, including notifying relevant emergency response authorities and selectively contacting the individual at the call-back telephone number, if provided, or at a telephone number previously stored in a user preferences database in association with the user's account. The personal alarm device may have either normal and duress alarm buttons or have a keypad for entry of either a normal PIN code or a duress PIN code.

26 Claims, 4 Drawing Sheets

PERSONAL ALARM DEVICE TRANSMITTING TELEPHONE NUMBER FOR ALARM CONFIRMATION AND INQUIRY

BACKGROUND OF THE INVENTION

1. Field of the Invention

The present invention relates to personal alarm devices for transmitting a call for assistance.

2. Description of the Related Art

A personal alarm device (PAD) is an electronic unit that is carried or worn by an individual so that the device is always available in the case of an emergency. Activation of the personal alarm device maybe as simple as the push of a button on the face of the device. In order to be carried or worn in a practical manner, the device must be cordless. Accordingly, the device will include a wireless transmitter for sending a wireless alarm signal to a receiver and a battery for providing power to the transmitter.

The wireless alarm signal may use any conventional wireless communications medium, including radio and infrared frequency signals. The wireless alarm signal is transmitted to a receiver that maybe located within the individual's home or office or to a receiver that is more remote, such as a radio tower or satellite. Regardless of the receiver's location, the alarm signal or a similar alarm signal is presumably retransmitted to a monitoring station. Once the wireless alarm signal has been received by the monitoring station, the information conveyed by the alarm signal is reported to emergency response professionals, such as the police, paramedics, and the like.

A limitation of these personal alarm devices is their inability to provide complete details of the conditions causing the alarm and the conditions following the receipt of the alarm. Ineffectiveness and inefficiencies in responding to the alarm arise from responding with either too little or too much seriousness. Conversely, attempts to obtain complete details about an emergency before initiating any type of response can lead to slow response times or complicated alarm and reporting systems.

One method of obtaining more information about the nature and severity of the emergency is to simply place a telephone call to the location where the personal alarm device or system is installed. While it is sometimes feasible to obtain more information about the emergency through a telephone call to the installed location, this method requires that the individual stay within the location.

Therefore, there is a need for a personal alarm device that is simple to operate, yet enables personnel at a monitoring station to obtain critical information about the nature and severity of the emergency. It would be desirable if the system provided for telephone contact when possible. It would also be desirable if telephone contact could be achieved without requiring the individual to be home-bound.

SUMMARY OF THE INVENTION

The present invention provides a method for responding to an alarm signal. The method includes receiving an alarm signal from a personal alarm device, wherein the alarm signal includes (i) an alarm code selected from a normal code and a duress code, and (ii) an account code. Optionally, the alarm signal may further include a current telephone number that is stored in the PAD. The method also includes notifying an emergency response authority that the alarm signal has been received, and initiating a telephone call to a telephone number provided by the user. The telephone number is either a default telephone number stored in user preferences for the account or a current telephone that has been entered into the PAD and transmitted in the alarm signal. If the alarm signal includes a duress code, then initiation of the telephone call is delayed for a preset time period following receipt of the alarm signal. The method may further include locating the account code in a database of active account codes, and comparing the alarm signal contents with a preregistered normal code and a preregistered duress code associated with the account code in the database to determine if the code is a valid normal code or a valid duress code. Preferably, the telephone number is provided to the emergency response authority.

The invention also includes a system comprising a personal alarm device, a central alarm monitor for receiving the alarm signals, means for notifying emergency response authorities of the alarm signal, and means for placing a call to the telephone number after a delay period if the duress alarm signal is received. The personal alarm device has a keypad, programmable register and a transmitter, wherein the transmitter transmits a normal alarm signal upon a first keypad entry and a duress alarm signal upon a second keypad entry, each alarm signal including, if programmed into the PAD, a current telephone number. The personal alarm device is preferably programmable for periodic entry of a current telephone number. If the PAD does not have a current telephone number stored in its memory at the time of the alarm signal, then the alarm service initiates the call using a telephone number provided in the user's preferences.

The invention further provides a method for responding to an alarm signal. The method comprises receiving an alarm signal from a personal alarm device, wherein the alarm signal includes a telephone number and either a duress code or a normal code, determining whether the alarm signal includes the duress code or the normal code, and notifying an emergency response authority that the alarm signal has been received. If the alarm signal includes the normal code, then a telephone call is initiated to the telephone number without waiting a predetermined delay period following receipt of the alarm signal. If the alarm signal includes the duress code, then a telephone call is initiated to the telephone number only after a predetermined delay period following receipt of the alarm signal.

The foregoing and other objects, features and advantages of the invention will be apparent from the following more particular description of a preferred embodiment of the invention, as illustrated in the accompanying drawing wherein like reference numbers represent like parts of the invention.

DETAILED DESCRIPTION

Figure 1:
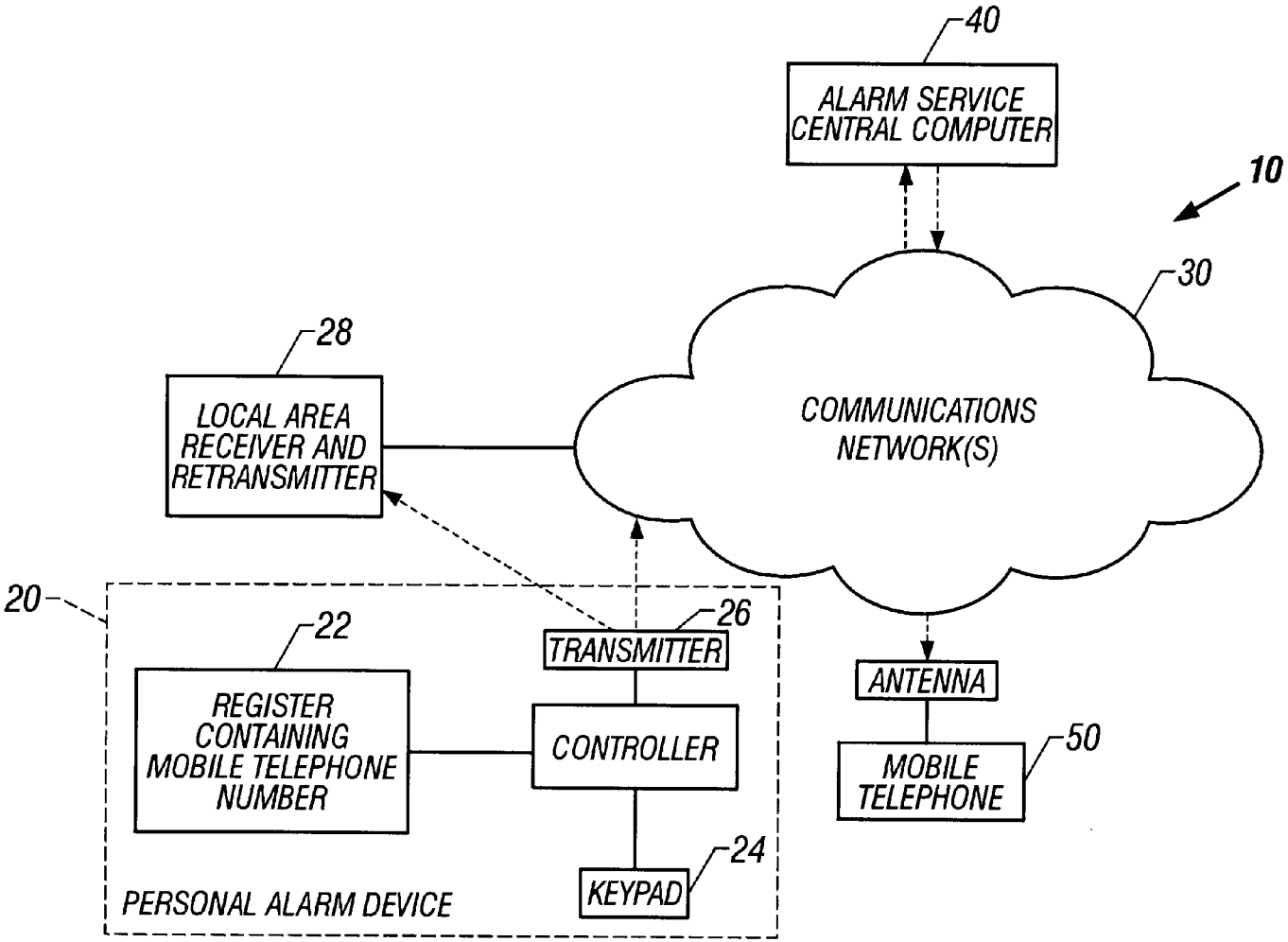
FIG. 1 is a schematic diagram of a system according to the present invention.

The present invention provides a system that allows individuals to transmit an alarm signal from a personal device having a keypad, programmable register, a transmitter, and a battery or other electrical power source. The alarm signal is transmitted to a receiver that maybe a personal receiver located in the immediate vicinity of the individual, such as in a home or office, that retransmits the alarm signal over radio waves or land lines to a central alarm monitoring server. Alternatively, the receiver is located at a distance to the individual, such as a regional tower or satellite, and retransmits the alarm signal over radio waves or land lines to the central alarm monitoring server. The central alarm monitoring server processes the alarm signal and initiates the necessary actions, including notifying relevant emergency response authorities.

The personal alarm device (PAD) of the present invention is programmable to allow the individual user, or a designated guardian or assistant, to enter and store a telephone number that a monitoring entity should use to inquire about the status of the individual setting off their personal alarm device. By allowing the individual to periodically enter a contact telephone number, the individual may have more freedom of movement. In particular, the individual may enter a personal telephone number corresponding to their home or office or, more preferably, enter a mobile telephone that the individual may carry. It should be noted that the invention is not limited to the type of telephone, e.g. wired or wireless, associated with the telephone number entered and that reference in the application to a mobile telephone maybe equally applicable to any type of phone whether mobile or not. The programmability of the telephone number is particularly useful in combination with a PAD transmitter that communicates with a regional, national or worldwide communications network, such as a mobile telephone system or satellite system, because the individual can travel to any destination with the security of the alarm and knowing that the alarm signal will provide the monitoring agency with the last telephone number entered.

The personal alarm device includes a keypad that facilitates both the entry of a telephone number into a memory register and initiates the transmission of an alarm signal. While the keypad maybe a full 10-number or 12-key keypad, the keypad may instead have a smaller set of keys that may be labeled with numbers, colors, shapes or any imaginable labels. Presumably, the smaller the set of keys on the keypad, the more keystrokes will be required to achieve entry of the telephone number or programming of the other code. For example, one button can be used to enter all digits 0 through 9 by scrolling.

The present invention also encompasses a method for transmitting an alarm signal using a personal alarm device, such as the personal alarm device described herein. In one embodiment, the method includes pushing a single button that triggers transmission of an alarm signal. In an alternative embodiment, the method includes entry of a personal identification number (PIN) that must match a prerecorded PIN stored in memory within the personal alarm device in order for an alarm signal to be transmitted. In either embodiment, the method preferably also includes transmission of a telephone number that is stored within a programmable memory register in the personal alarm device. Even more preferably, the programmable memory register can store multiple telephone numbers, such as a default telephone number and a current telephone number.

In a preferred embodiment of the invention, the personal alarm device has two buttons, a first button for triggering transmission of a normal alarm and a second button for triggering transmission of a duress alarm. In an alternate preferred embodiment, the personal alarm device recognizes two PINs, including a normal PIN and a duress PIN, wherein an individual would enter a normal PIN to indicate that the nature of the emergency is non-aggravated (not under duress), such as a medical problem. Conversely, an individual would enter a duress PIN to indicate that the nature of the emergency is aggravated (under duress), such as a hostile person threatening immediate bodily injury. In this latter case where the person is under duress, emergency response authorities will respond in a different manner, preferably to avoid alerting the hostile person to the fact that an alarm signal has been triggered. Specifically, if a call-back or contact telephone number is provided in the case of a duress code, then the emergency response authorities will begin taking action, but avoid calling the telephone number for a certain time period.

The alarm signal is directly or indirectly received by a central alarm server for monitoring alarm signals and notifying emergency response authorities of the alarm signal. The central alarm server will contain a database of registered accounts and relevant information associated with the account, such as the normal code, the duress code, and specific personal information about the user of the PAD, for example that the user has a heart condition or is in a wheelchair. Accordingly, the central alarm service can rapidly determine, upon receiving an alarm signal, whether the alarm signal includes a valid account, whether the alarm signal includes a valid normal code or valid duress code, and whether the alarm signal includes a call-back telephone number. In embodiments having alarm buttons that do not require a PIN entry, the duress code may consist essentially of a single bit that indicates duress (such as a "1") or not duress (such as "0").

While the system and methods of the present invention may be used in any of a variety of types of emergencies, the invention makes a primary distinction between those emergencies that involve duress and those emergencies that do not involve duress. This primary distinction is made because it fundamentally affects the process of responding to the alarm signal. In most emergencies, such as medical and fire, it is most helpful to establish communication with the affected individual or someone with the affected individual. This allows the emergency response authority to assign an appropriate priority and resource to address the emergency. By contrast, where the emergency involves duress, it is understood that the individual is in a situation where the individual may suffer further harm should it become apparent that an alarm has been triggered. Consequently, direct communication from the emergency response authority to the affected individual maybe purposely delayed.

FIG. 1 is a schematic diagram of a system 10 according to the present invention. The system 10 includes a personal alarm device or PAD 20 that can communicate over a communications network or networks 30 to a central alarm server 40. The server 40 may also communicate over the same or different communications network or networks 30 to a telephone 50, which is preferably a mobile telephone. The PAD 20 includes a programmable register or memory 22 capable of storing a telephone number, such as the telephone number for telephone 50. The PAD also includes a keypad 24 for entering telephone numbers and PIN codes to activate the alarm. Finally, the PAD also includes a transmitter 26 that allows the PAD to send wireless alarm signals.

The communications network 30 is the medium used to provide communications links between the PAD 20, server 40 and telephone 50. Network 30 may include permanent connections, such as wire or fiber optic cables, or temporary connections made through telephone or wireless communications. In the depicted example, the network may include a wired or wireless telephone system, satellite system, and/or the Internet representing a worldwide collection of networks and gateways that use the TCP/IP suite of protocols to communicate with one another. Of course, the system may also include a number of different types of networks, such as, for example, an intranet, a local area network (LAN), or a wide area network (WAN).

Optionally, the system may include a local receiver/retransmitter 28 that receives the alarm signal transmitted by the PAD and retransmits the alarm signal by the same or different medium. This optional embodiment maybe advantageous since the presence of the receiver/retransmitter in the local area of the PAD, such as in a home or small office, allows the PAD to be small and low-powered while providing reliable and clear communications.

The central alarm monitoring server 40 includes a conventional server software program, such as International Business Machines' Websphere®, for administering the monitoring process and maintaining account databases. The server software includes application programs that enable the server 40 to receive and process alarm signals and notify the appropriate emergency response authorities.

Figure 2:
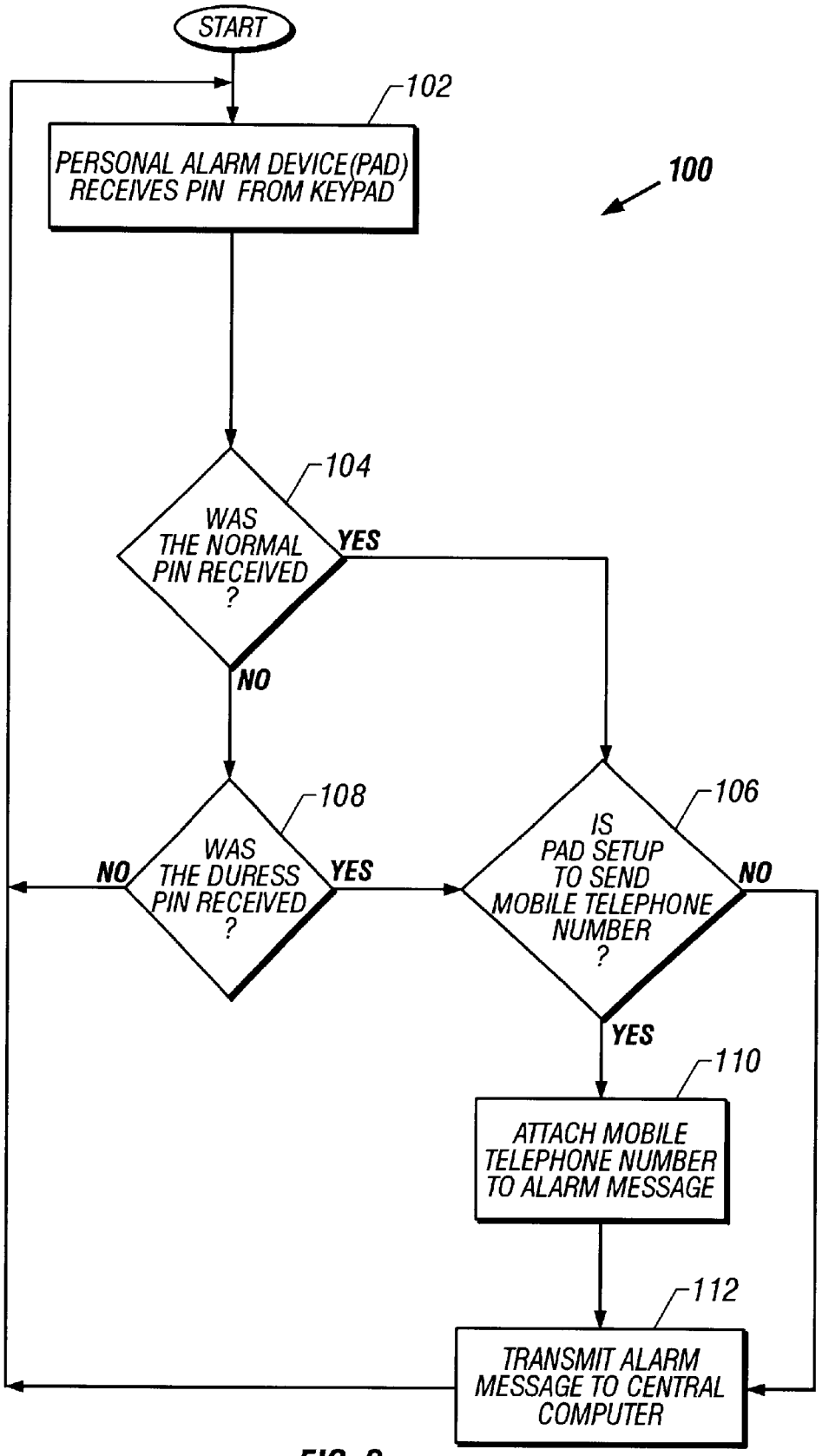
FIG. 2 is a flow diagram of a process executed by a personal alarm device requiring entry of a personal identification number (PIN) to trigger an alarm.

FIG. 2 is a flow diagram of a process 100 executed by the personal alarm device 20 requiring PIN entry to trigger an alarm. In state 102, the personal alarm device receives a personal identification number (PIN) from the keypad. In state 104, the PAD determines whether PIN received was the normal PIN. If the normal PIN was received, then in state 106, it is determined whether the PAD has been set up to send a telephone number. If the PAD is not set up to send a telephone number, then in state 112, the PAD transmits the alarm message to the central computer, where the alarm message or signal includes the normal PIN without a telephone number, and the telephone number is used which is contained in the user's preferences stored at the alarm service. If, however, the PAD is in fact set up to send a telephone number, then in state 110, a telephone number stored in the PAD is attached to the alarm message. Accordingly, in state 112, the alarm message is transmitted to the central computer, this time including both the normal PIN and the stored telephone number, which overrides the telephone number stored in the user's preferences.

If in state 104, the PIN is not the normal PIN, then the PAD determines, in state 108, whether the PIN is a special PIN, such as a duress PIN. If the PIN is not a special PIN, then the process returns to prepare for receiving another PIN in state 102. If it is determined that the PIN is a duress PIN in state 108, then in state 110, a telephone number stored in the PAD may be attached to the alarm message. Accordingly, in state 112, the alarm message is transmitted to the central computer, this time including both the special PIN and the stored telephone number. Following transmission of the alarm message to the central computer, then the process returns to prepare for receiving another PIN in state 102.

Figure 3:
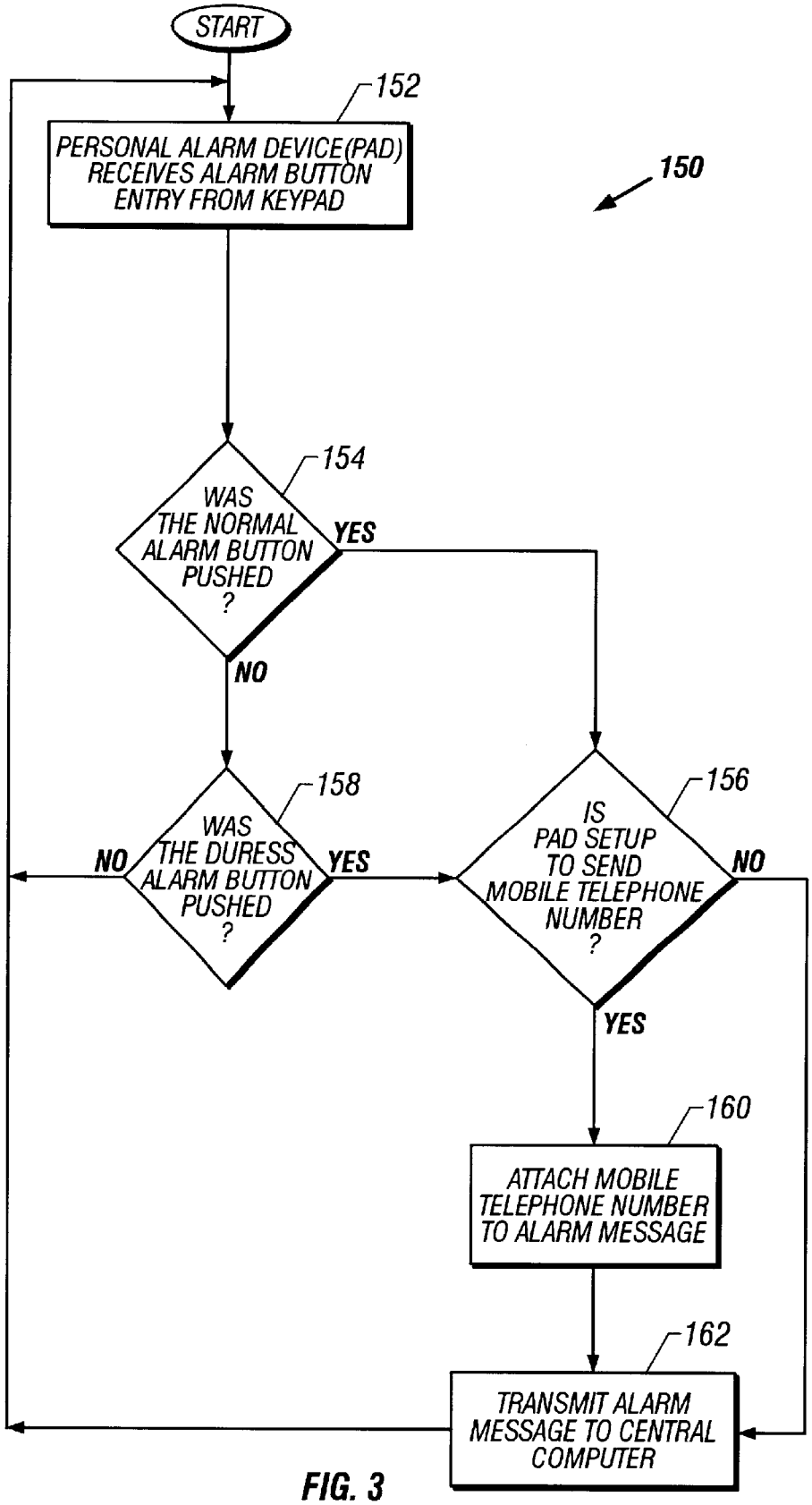
FIG. 3 is a flow diagram of a process executed by a personal alarm device having a normal alarm button and duress alarm button.

FIG. 3 is a flow diagram of a process 150 executed by a personal alarm device 20 having a keypad with normal alarm and duress alarm buttons. In state 152, the personal alarm device receives an alarm button entry from the keypad. In state 154, the PAD determines whether the normal alarm button was pushed. If the normal alarm button was pushed, then in state 156, it is determined whether the PAD has been set up to send a telephone number. If the PAD is not set up to send a telephone number, then in state 162, the PAD transmits the alarm message to the central computer, where the alarm message or signal includes the normal alarm code without a telephone number. If, however, the PAD is in fact set up to send a telephone number, then in state 160, a telephone number stored in the PAD is attached to the alarm message. Accordingly, in state 162, the alarm message is transmitted to the central computer including both the normal alarm code and the stored telephone number.

If in state 154, the normal alarm button was not pushed, then the PAD determines, in state 158, whether the duress alarm button was pushed. If the duress alarm button was not pushed, then the process returns to prepare for receiving another keypad entry in state 152. If it is determined that the duress alarm button was pushed in state 158, then in state 160, a telephone number stored in the PAD maybe attached to the alarm message. Accordingly, in state 162, the alarm message is transmitted to the central computer, the alarm message including both the duress alarm code and the stored telephone number. Following transmission of the alarm message to the central computer, then the process returns to prepare for receiving another keypad entry in state 152.

Figure 4:
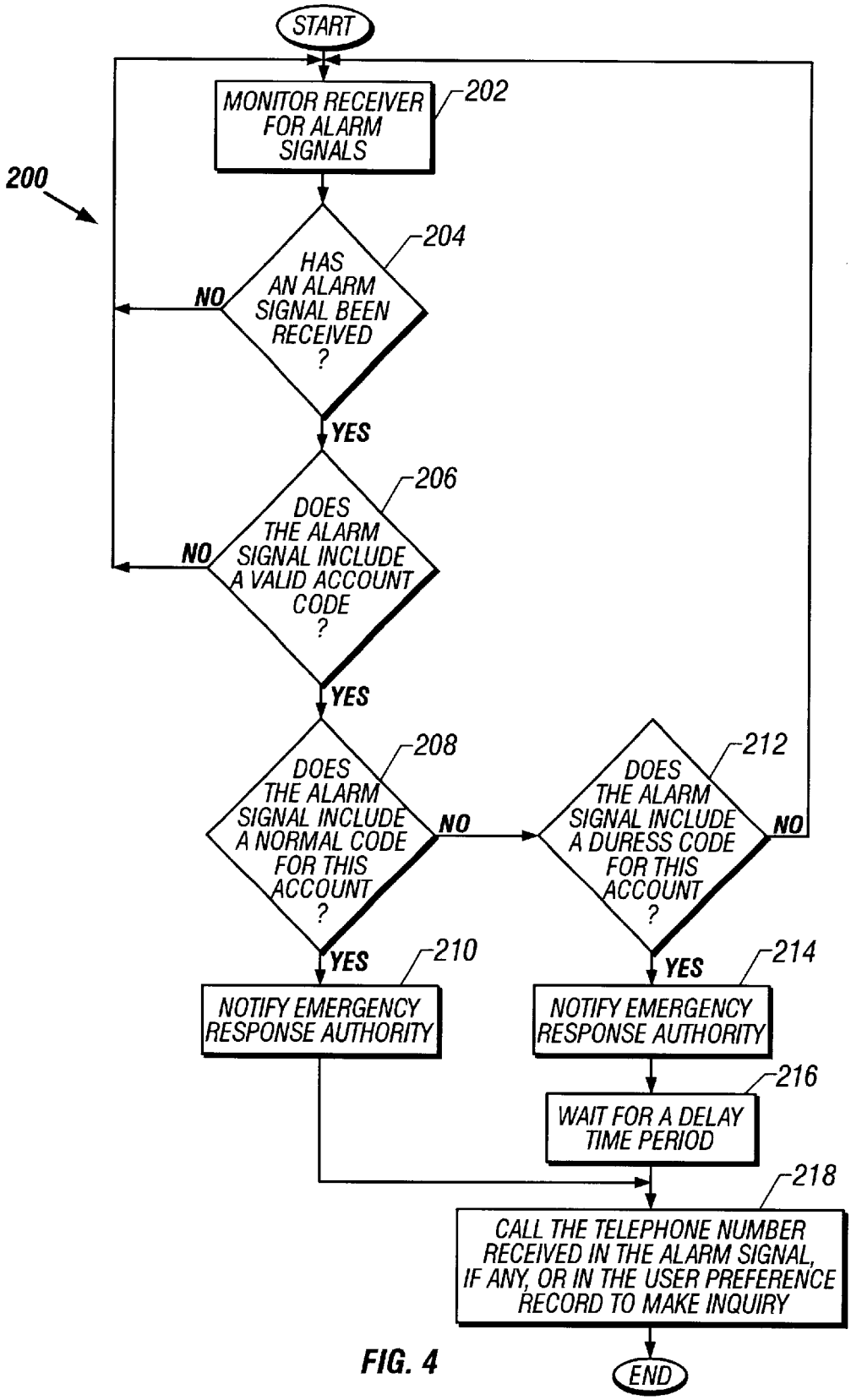
FIG. 4 is a flow diagram of a process executed by a central alarm monitor.

FIG. 4 is a flow diagram of a process 200 executed by a central alarm monitor 40. In state 202, the central alarm server monitors its receiver for alarm signals. In state 204, the central alarm server determines whether an alarm signal has been received. If an alarm signal has not been received, then the process returns to monitor the receiver in state 202. If an alarm signal has been received, then the central alarm server determines whether the alarm signal includes a valid account code in state 206. If the alarm signal does not include a valid account code, then the process returns to monitor the receiver in state 202. If a valid account code has been received, then it is determined in state 208 whether the alarm signal includes a valid normal code for the valid account code. If a valid normal code for the account has been received, then in state 210, the central alarm server 40 notifies an emergency response authority about the alarm, and calls the telephone number stored in the user preference record or the telephone number included in the alarm signal.

If an alarm signal includes a valid account code as determined in state 206, but does not include the normal alarm code as determined in state 208, then in state 212, the central alarm server determines whether the alarm signal includes a valid duress code for the valid account code. If there is not a valid duress code in the signal, then the process returns to state 202. If a valid duress code was received, then the central alarm server notifies an emergency response authority in state 214, waits for a delay time period in state 216, and then in state 218 calls the telephone number received in the alarm signal, if any, or the telephone number stored in the user preference record to make inquiry regarding the nature and severity of the emergency.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A method for responding to an alarm signal comprising:

receiving an alarm signal from a personal alarm device, wherein the alarm signal includes an account code, and an alarm code select from a normal code and a duress code;

notifying an emergency response authority that the alarm signal has been received; and initiating a telephone call to a telephone number associated with the account code.

2. The method of claim 1, wherein the telephone number that is called is selected from a telephone number included in the alarm signal, a telephone number previously stored in a database in association with the account code, and combinations thereof.

3. The method of claim 2, wherein the previously stored telephone number is called only if no telephone number is included in the alarm signal.

4. The method of claim 1, further comprising:

delaying initiation of the telephone call for a preset time period following receipt of an alarm signal that includes the duress code.

5. The method of claim 1, further comprising:

providing the telephone number to the emergency response authority.

6. The method of claim 1, wherein the alarm code is a normal code upon pushing a normal button on the personal alarm device, and wherein the alarm code is a duress code upon pushing a duress button on the personal alarm device.

7. The method of claim 1, wherein the alarm code is a personal identification number selected from a normal personal identification number and a duress personal identification number.

8. The method of claim 7, further comprising:

locating the account code in a database of active account codes; and determining whether the personal identification number received in the alarm signal is the same as either the normal personal identification number or the duress personal identification number previously stored in a database in association with the account code.

9. A system for responding to an alarm signal, comprising:

receiving means for receiving an alarm signal from a personal alarm device, wherein the alarm signal includes an account code, and an alarm code select from a normal code and a duress code;

notifying means for notifying an emergency response authority that the alarm signal has been received; and initiating means for initiating a telephone call to a telephone number associated with the account code.

10. The system of claim 9, wherein the telephone number that is called is selected from a telephone number included in the alarm signal, a telephone number previously stored in a database in association with the account code, and combinations thereof.

11. The system of claim 10, wherein the previously stored telephone number is called only if no telephone number is included in the alarm signal.

12. The system of claim 9, further comprising:

delaying means for delaying initiation of the telephone call for a preset time period following receipt of an alarm signal that includes the duress code.

13. The system of claim 9, further comprising:

transmitting means for transmitting the telephone number to the emergency response authority.

14. The system of claim 9, wherein the alarm code is a normal code upon pushing a normal button on the personal alarm device, and wherein the alarm code is a duress code upon pushing a duress button on the personal alarm device.

15. The system of claim 9, wherein the alarm code is a personal identification number selected from a normal personal identification number and a duress personal identification number.

16. The system of claim 15, further comprising:

locating means for locating the account code in a database of active account codes; and determining means for determining whether the personal identification number received in the alarm signal is the same as either the normal personal identification number or the duress personal identification number previously stored in a database in association with the account code.

17. A system comprising:

a personal device having a keypad, programmable register and a transmitter, wherein the transmitter transmits a first alarm signal upon a first keypad entry and a second alarm signal including a telephone number upon a second keypad entry; and a central alarm monitor for receiving the alarm signals;

means for notifying emergency response authorities of the alarm signal; and means for placing a call to the telephone number after a delay period if the second alarm signal is received.

18. The system of claim 17, wherein the personal device is programmable for periodic entry of a current telephone number.

19. A computer program product, comprising:

receiving instructions for receiving an alarm signal from a personal alarm device, wherein the alarm signal includes an account code, and an alarm code select from a normal code and a duress code;

notifying instructions for notifying an emergency response authority that the alarm signal has been received; and initiating instructions for initiating a telephone call to a telephone number associated with the account code.

20. The computer program product of claim 19, wherein the telephone number that is called is selected from a telephone number included in the alarm signal, a telephone number previously stored in a database in association with the account code, and combinations thereof.

21. The computer program product of claim 20, wherein the previously stored telephone number is called only if no telephone number is included in the alarm signal.

22. The computer program product of claim 19, further comprising:

delaying instructions for delaying initiation of the telephone call for a preset time period following receipt of an alarm signal that includes the duress code.

23. The computer program product of claim 19, further comprising:

transmitting instructions for transmitting the telephone number to the emergency response authority.

24. The computer program product of claim 19, wherein the alarm code is a normal code upon pushing a normal button on the personal alarm device, and wherein the alarm code is a duress code upon pushing a duress button on the personal alarm device.

25. The computer program product of claim 19, wherein the alarm code is a personal identification number selected from a normal personal identification number and a duress personal identification number.

26. The computer program product of claim 25, further comprising:

locating instructions for locating the account code in a database of active account codes; and determining instructions for determining whether the personal identification number received in the alarm signal is the same as either the normal personal identification number or the duress personal identification number previously stored in a database in association with the account code.

* * * * *